United States Patent [19]

Sato et al.

[11] Patent Number: 4,531,344

[45] Date of Patent: Jul. 30, 1985

[54] DEVICE FOR ALIGNING AND BANDING A PILE OF PAPER SHEETS

[75] Inventors: Koji Sato, Hiratsuka; Hikaru Kawano, Odawara, both of Japan

[73] Assignees: Musashi Co., Ltd., Tokyo; Hitachi Denshi Engineering Kabushiki Kaisha, Kanagawa, both of Japan

[21] Appl. No.: 449,169

[22] Filed: Dec. 13, 1982

[30] Foreign Application Priority Data

Dec. 19, 1981 [JP] Japan ..... 56-205866

[51] Int. Cl.[3] ..... B65B 35/50; B65B 13/12

[52] U.S. Cl. ..... 53/447; 53/540; 414/43; 414/907

[58] Field of Search ..... 53/447, 529, 540, 589, 53/593, 588; 414/43, 907

[56] References Cited

U.S. PATENT DOCUMENTS

| | | | |
|---|---|---|---|
| 3,777,906 | 12/1973 | Stolzmann et al. | 414/38 |
| 4,020,608 | 5/1977 | Seragnoli | 53/234 |
| 4,073,123 | 2/1978 | Schoppee | 53/234 |
| 4,383,788 | 5/1983 | Sylvander | 414/907 |
| 4,424,660 | 1/1984 | Sato et al. | 53/588 |
| 4,492,070 | 1/1985 | Morse et al. | 53/447 |

*Primary Examiner*—Lowell A. Larson

*Attorney, Agent, or Firm*—Brooks Haidt Haffner & Delahunty

[57] ABSTRACT

The stacker of the device for aligning and banding paper sheets is movable between a lower position for receiving and holding paper sheets from a supply belt and an upper position for forwarding the paper sheets to a subsequent step. A coil spring is connected at one end to a fixed part and at the other to a movable operating unit, and is associated with a holding plate through the operating unit. When the stacker has been moved to the upper position, the holding plate is moved upwards relative to the stacker to clear the stack of paper sheets in the stacker.

7 Claims, 2 Drawing Figures

DEVICE FOR ALIGNING AND BANDING A PILE OF PAPER SHEETS

BACKGROUND OF THE INVENTION

This invention relates to an improved device for aligning and banding a pile of paper sheets, especially banknotes.

So far, in this type of aligning and banding device, there exists the tendency for the individual paper sheets of a pile or stack resting in a stacker to be displaced relative to one another and misaligned when the stack is in the upper position. This is because a holding plate acts on the stack of paper sheets not only when the stacker is in the lower position, but when the stacker is in the upper position.

Moreover, when an error has occurred in counting the number of the paper sheets, the holding plate of the conventional device does not become disengaged from the paper sheets even when the stacker is in the upper position. While it is necessary in such instances to take the paper sheets out of the stacker before the operation of the device is started again, it is difficult in the conventional devices to take the paper sheets out of the stacker.

SUMMARY OF THE INVENTION

It is an object of the present invention to provide means extremely suitable for removing the above shortcomings and provide a device for aligning and banding a pile of paper sheets in which the stacker is movable between an upper position and a lower position and, when the stacker is moved to the upper position, a holding plate adapted for holding the paper sheets is disengaged from the sheets.

BRIEF DESCRIPTION OF THE DRAWINGS

This invention will become more readily apparent from the following description of a preferred embodiment shown, by way of example only, in the accompanying drawings, in which.

DESCRIPTION OF THE PREFERRED EMBODIMENT

Figure 1:
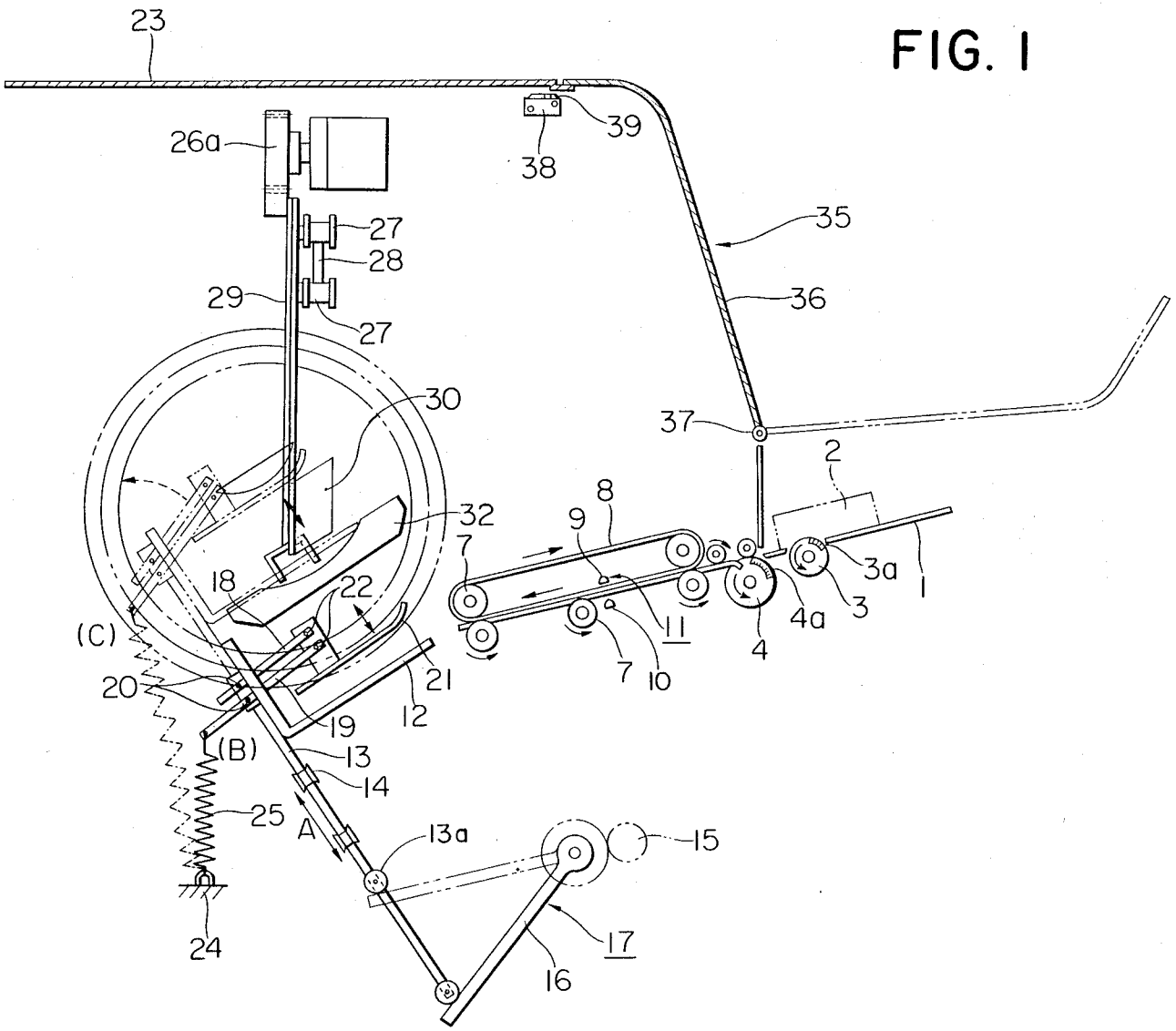
FIG. 1 is a cross-sectional side elevation showing a device for aligning and banding paper sheets embodying the present invention.

In the drawings, the numeral 1 designates a hopper designed for holding a pile or stack of paper sheets 2 such as bank notes. Adjacent to this hopper, shown only diagrammatically, an auxiliary guide roll 3 is mounted for rotation in the direction of the arrow mark for transferring the paper sheets one at a time. Adjacent to this guide roll 3, a separating drum 4 is mounted for rotation in the direction of the arrow mark and constitutes a separating section for separately feeding the paper sheets 2 from the hopper 1 one at a time.

The paper sheets 2 fed by the separating drum 4 one by one are clamped between a plurality of supply rolls 7 and a supply belt 8 and transferred in this state further. The state of transfer of the paper sheets 2 is monitored by a counter and sensor 11 composed of a light emitting element 9 and a light receiving element 10 mounted on both sides of the feed belt 8. The counter and sensor thus counts the number of the paper sheets being transferred. High frictional coefficient zones 3*a*, 4*a* are provided to selected portions of the peripheral surfaces of the guide roll 3 and the separating drum 4.

Adjacent to the outlet end of the supply belt 8, a substantially L-shaped stacker 12 is secured to a guide rail 13 in a slightly tilted or angular position with respect to the direction of feed of the feed belt 8. The guide rail 13 is movable in turn along a straight path in the direction of the arrow mark A between a plurality of fixed guide rolls 14. These guide rolls are adapted for rotation about their own axes and are mounted to some stationary portion of a casing member 23. The stacker 12 attached to the guide rail 13 may be moved by the operation of a drive unit 17 formed by the guide rail 13, a drive motor 15 and a drive arm 16 which engages a roller 13*a* on the lower end of the rail 13. The drive arm 16 is operatively associated with the drive motor 15 and moved thereby between a solid line position and a double dotted chain line position in FIG. 1. When the drive arm 16 is in the solid line position in FIG. 1, the stacker 12 is also in the solid line position or in the lower position B and, when the drive arm 16 is in the double-dotted chain line position in FIG. 1, the stacker 12 is in the double-dotted chain line position or in the upper position C.

To one side of the stacker 12 opposite from the supply belt, there is rotatably mounted by a fulcrum part 20 an operating unit consisting of a pair of parallel arms 18, 19. A keep plate or holding plate 21 is mounted to one end of each of the arms 18, 19 for rotation by a fulcrum part 22. To the other end of the arm 19 is connected one end of a coil spring 25, the the other end whereof is secured to a stationary portion 24 of the caseing member 23.

An end plate 30 of a transfer arm 29 may be placed substantially in a position occupied by the stacker 12 when in the raised position C. The transfer arm 29 is secured to a transfer rack 26 and movable therwith by a pair of rolls 27 and a guide rail 28 in the direction of the arrow mark D. A pinion 26*a* meshing with rack 26 is adapted for rotation about its axis and mounted to some fixed portion of the casing member. The transfer arm 29 is movable, by operation of the pinion 26*a*, to transfer the paper sheets 2 on the stacker 12 onto a support saucer 32 of a banding unit 31 where the stack of paper sheets 2 may be bundled tightly by a sealing band, not shown, by a banding device formed by a flyer 34 having guide pins 33. The banding unit and the banding device are shown in detail in U.S. Pat. No. 4,117,650.

In a take-out opening 35 of the main casing 23, there is hingedly mounted a door 36 by a fulcrum part 37, and a switch 38 is mounted at one end of the take-out opening 35. An operating lever 39 for the switch 38 is mounted for abutting an one end of the door 36 in such a manner that the switch 38 is turned on or off when the door 36 is opened or closed, respectively.

This switch 38 is connected to a control circuit, not shown, of the driving motot 15 in such a manner that, when the switch 38 is turned on, the driving motor 15 is actuated for displacing the arm 16 from the solid-line position to the double-dotted chain line position in FIG. 1.

Figure 2:
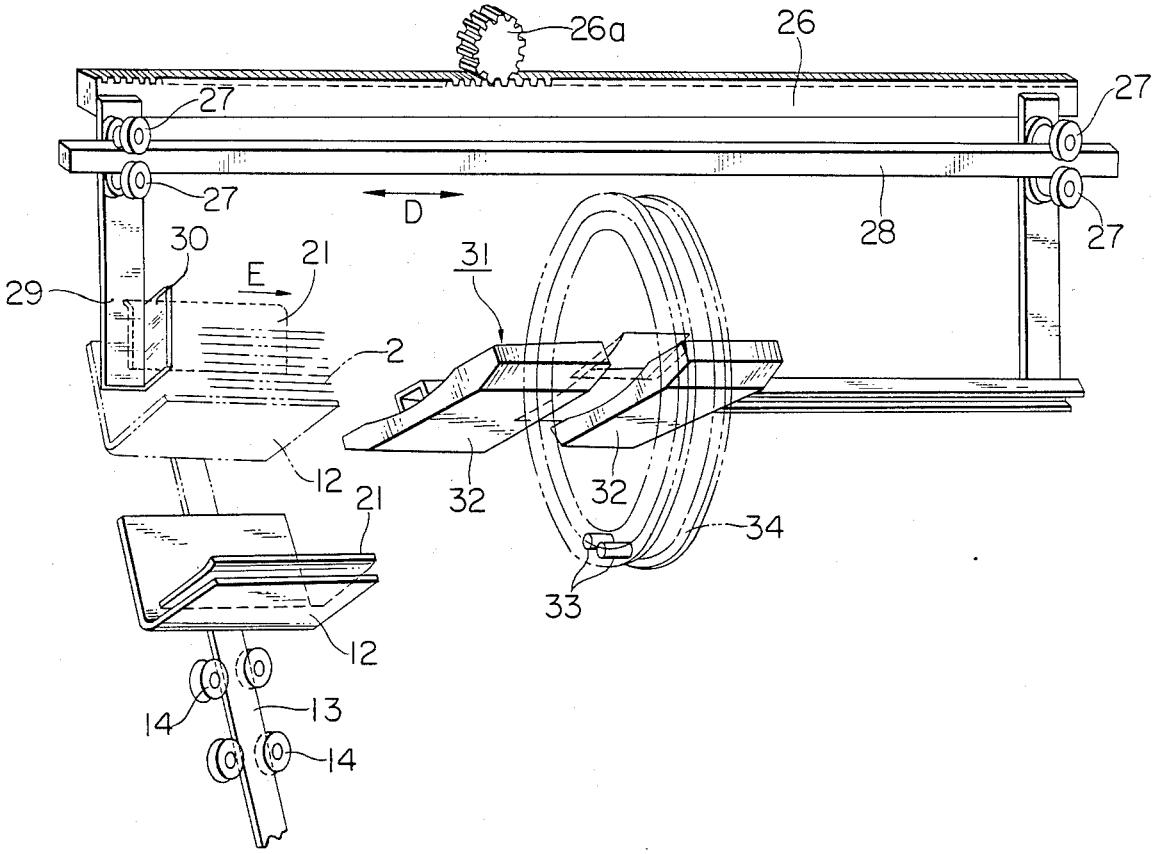
FIG. 2 is a perspective view showing substantial parts of the device shown in FIG. 1.

In the operation of the paper sheet aligning and banding device according to the present invention, the paper sheets 2 supplied by the transfer belt 8 are supplied consecutively into the stacker 12. When the latter is in the lower position B, the force of the spring 25 does not act substantially on the holding plate 21 so that the latter falls by its own weight to hold a fixed number of, e.g. one hundred paper sheets 2 in the stacker 12 under its own gravity. The sheets are fed to the underside of the stack until the desired number of sheets has been counted by the sensor and counter 11, at which time the drive of the belt 8 is automatically stopped. Preferably, the stacker 12 has a plurality of transverse rollers (not shown) thereon, which facilitate the movement of subsequent sheets onto the bottom of the stack. When the driving arm 16 is turned in this state for displacing the stacker 12 to its upper position C for banding the sheets 2, the spring 25 is in the extended state. The force of this spring then acts to turn the arms 18, 19 counterclockwise in the direction of the dot-dash arrow in FIG. 1, so that the plate 21 is urged upwardly to clear the paper sheets 2 which now remain stacked on the stacker 12, with the number of the paper sheets being fixed as mentioned above. In this state, the pinion 26*a* is then driven in rotation so that the end plate 30 of the transfer arm 29 acts to thrust the edge of the stack of paper sheets 2 in the direction of the arrow mark E in FIG. 2. Thus the stack of the paper sheets 2 is shifted onto the support saucer 32. The flyer 34 is then driven into rotation for placing a band, not shown, around the stack of paper sheets 2 by the operation of the guide pins 33. This completes the banding operation for one stack of paper sheets.

When a transfer error or counting error is signalled by the counter and sensor 11 as having occurred in the state shown in FIG. 1, the door 36 is manually opened to its position as shown by the double-dotted chain line in FIG. 1, the operating lever 39 of the switch 38 being thus raised and the switch 38 automatically turned on. The belt 8 is stopped at the end of the counting operation, whereupon the driving motor 15 is set into rotation. The driving arm 16 is turned in this manner for raising the stacker 12 from its lower position B to its upper position C in the same manner as mentioned above. Simultaneously, the holder plate 21 is moved apart from the stack of paper sheets 2 to permit the sheets 2 to be taken out through the take-out opening 35 to remedy the transfer or counting error.

In the construction of the paper sheet aligning and banding device of the present invention, as mentioned above, since the holding plate does not hold the stack of paper sheets in the course of upward travel of the stack of paper sheets, the paper sheets can be displaced easily without shifting their relative position. In addition, in case of occurrence of counting errors, the paper sheets can be taken out by manipulation of the door to remedy the counting errors.

What is claimed is:

1. A device for aligning and banding stacked paper sheets comprising:

a hopper adapted for holding paper sheets in a stacked state;

a separating drum for separating the paper sheets and feeding them one at a time in generally horizontally oriented condition;

a generally horizontal supply belt having a receiving end for receiving the paper sheets sequentially from said separating drum and an outlet end for discharging the paper sheets from the belt;

a counter and sensor adapted for sensing the paper sheets supplied by said supply belt and counting the number of the paper sheets;

a generally horizontal stacker mounted for substantially linear vertical reciprocal movement between an upper position and a lower position adjacent said supply belt outlet end for receiving and stacking a predetermined number of the horizontally oriented paper sheets as they are supplied thereto by said supply belt and counted by said counter and sensor;

a driving means for moving said stacker from its said lower position to its said upper position when said predetermined number of sheets are stacked thereon;

a banding device laterally adjacent to said upper position of said stacker for receiving and banding the paper sheets from said stacker;

laterally movable pusher means for moving said stack of paper sheets laterally from said stacker when in its said upper position and onto said banding device;

an operating unit mounted for movement on said stacker between a substantially horizontal position and a substantially vertical position thereof and carrying a holding plate for holding said sheets in their stacked condition as they are received on said stacker when in its said lower position; and biasing means having one end connected to said operating unit and a second end in fixed position for biasing said operating unit in a direction such that, when said stacker has been moved to said upper position, said operating unit is moved to its said substantially vertical position and said holding plate is out of engagement with said paper sheets.

2. The device as claimed in claim 1 comprising a housing, a door openably and closably mounted on said housing substantially adjacent to said hopper, and a switch operatively linked to opening and closure of said door for controlling the operation of said driving means in such a manner that opening said door activates said driving means for elevating said stacker to its said upper position.

3. The device as claimed in claim 2 wherein said driving means comprises a driving motor, a driving arm driven by said driving motor, and a guide rail engaging one end of said driving arm and movable along a straight path responsive to movement of said driving arm, said stacker being mounted on said guide rail.

4. The device as claimed in claim 1 wherein said operating unit comprises a pair of parallel, laterally spaced apart arms each pivotably connected at one of their ends to said holding plate and at the other of their ends to said stacker, one of said arms having a portion of its length at its said other end extending beyond the location of said pivotal connection thereof to said stacker, said one end of the biasing means being connected to said extending length portion of said one arm.

5. The device as claimed in claim 1 wherein said biasing means comprises a coil spring.

6. The device as claimed in claim 1 wherein said stacker is angularly disposed with respect to said supply belt and has substantially the shape of a letter L in side elevation, the base and side part of the letter L supporting said paper sheets.

7. The device as claimed in claim 1 wherein said driving means comprises a driving motor, a driving arm driven by said driving motor, and a guide rail engaging one end of said driving arm and movable along a straight path responsive to movement of said driving arm, said stacker being mounted on said guide rail.

* * * * *